US006575724B2

(12) United States Patent
Schlüsselbauer

(10) Patent No.: US 6,575,724 B2
(45) Date of Patent: Jun. 10, 2003

(54) APPARATUS FOR THE PRODUCTION OF RING-SHAPED BODIES FROM CONCRETE

(76) Inventor: Johann Schlüsselbauer, Obergmain 2, 4674 Altenhof (AT)

( * ) Notice: Subject to any disclaimer, the term of this patent is extended or adjusted under 35 U.S.C. 154(b) by 58 days.

(21) Appl. No.: 09/821,633

(22) Filed: Mar. 29, 2001

(65) Prior Publication Data

US 2002/0092262 A1 Jul. 18, 2002

(30) Foreign Application Priority Data

Jan. 16, 2001 (EP) ..... 01100160

(51) Int. Cl.[7] ..... B28B 21/74

(52) U.S. Cl. ..... 425/193; 425/426; 425/432; 425/469

(58) Field of Search ..... 425/193, 262, 425/426, 432, 457, 469; 249/100

(56) References Cited

U.S. PATENT DOCUMENTS 3,696,182 A 10/1972 Joelson
3,922,133 A * 11/1975 Crawford et al. ..... 425/262
5,648,108 A * 7/1997 Hvidegaard ..... 425/426

FOREIGN PATENT DOCUMENTS

DE 33 23 340 1/1985
EP 0 351 325 1/1990
EP 0 675 787 10/1995
WO WO 94/13448 6/1994

* cited by examiner

*Primary Examiner*—James P. Mackey
(74) *Attorney, Agent, or Firm*—The Maxham Firm

(57) ABSTRACT

An apparatus for the production of ring-shaped bodies of concrete, such as pit linings, pipes or the like. The apparatus includes a liftable and lowerable exterior mold, a mold space radially limiting the mold core toward the inside, at least one shaking device for introducing vibrations into the filled-in concrete, a bottom faucet closing the mold space at the bottom for shaping the lower centering end of the ring-shaped body, an upper mold faucet for shaping the upper centering end of the ring-shaped body. The apparatus also comprises an upper ring-shaped collar and a liftable and lowerable, rotatable pressure head and includes a coupling device which is provided with at least two clamping units distributed on the circumference of the pressure head, the motor-operated clamping jaws of said clamping units engaging the ring-shaped collar of the mold faucet. The outer diameter of the coupling device is smaller than the inner diameter of the exterior mold so that the exterior mold can be removed with the coupling activated and the mold faucet held down. Further, each clamping unit is provided with a pressure cylinder the cylinder housing of which, being disposed radially shiftable in the effective direction on the inside, is fixedly connected to the radially outer clamping jaw sustainer by means of at least one connection strut and the piston of which, acting radially outwardly, engages the radially inner clamping jaw sustainer.

13 Claims, 4 Drawing Sheets

APPARATUS FOR THE PRODUCTION OF RING-SHAPED BODIES FROM CONCRETE

BACKGROUND

1. Field of the Invention

The invention relates to an apparatus for the production of ring-shaped bodies from concrete, such as pit linings, pipes or the like.

2. Background Discussion

Due to the releasable connection between the pressing head and the upper mold faucet devices for the production of circular ring-shaped or oval concrete pipes, pit linings or other molded bodies have the practically important advantage that the upper mold faucet may remain on the yet plastic ring-shaped body as a kind of protective cap after the molding operation and will thus protect the delicate upper centering end from damage during transport or in the drying area. To this end it is known, for example, from German patent 33 23 340, to leave the upper faucet forming a mold cover on the molded concrete body until it has sufficiently hardened, and to releasably fix it to the piston head by means of a positive catch coupling during the molding operation. The coupling device requires an exact positioning of the upper mold faucet with respect to the pressure head so that the coupling elements to be positively connected can actually be effectively connected.

Further, a production facility for reinforced concrete pipes preferably having an oval cross section is known from U.S. Pat. No. 3,696,182 in which a special coupling device is provided for attaching and releasing the upper mold faucet to and from a faucet mount. The coupling device consists of motor-driven, liftable and lowerable rods guided along the sleeve of a hollow cylindrical support head, a radial collar being formed on the bottom end of each of the rods. The collars engage special pockets formed in a circumferential wall of the mold faucet during a coupling operation. The axially acting support forces for the mold faucet are the result of the positive connection between the collars of the rod ends and the integrated pockets also in this case so that, in this case too, no coupling effect based only on clamping forces is present.

In another production device for hollow concrete bodies known from European patent publication 0 675 787, a coupling device is used to establish a non-positive engagement of a mold faucet on an upper ring collar, the coupling device consisting of a dimensionally stable ring-shaped body, a flexible pressure tube disposed thereon, and a divided clamping ring. For establishing an engagement with a previously positioned mold faucet the ring-shaped body rigidly attached to the pressure head is clapped over the ring-shaped collar of the respective mold faucet, and the clamping ring is continuously and firmly pressed to the outer wall of the ring-shaped collar by blowing up the flexible ring-shaped tube. Thereafter the mold faucet may be placed on the upper end of the mold or the molded material by a corresponding movement of the pressure head and turned back and forward while applying an axial pressure around the mold axis. To release the clamping connection the ring-shaped tube is emptied, and the clamping ring is spread open by internal springs. For enabling a vertical removal of the exterior mold even with the coupling device activated the outer diameter of the coupling device is smaller than the inner diameter of the exterior mold so that the latter can be pulled up without colliding with the coupling device. A disadvantage of the known device is, among others, the insufficient adjustment of the coupling device to different mold faucet sizes due to the small free space between the ring-shaped collar and the clamping ring when the tube is deflated. Further, the device is technically complex since it requires a pressure air supply including a corresponding control means. Finally, disturbances of the production processes often occur which are caused by the entry and deposition particularly of granular concrete components into the ring-shaped gap of the coupling device and damage to the flexible ring-shaped tube possibly caused thereby.

Finally, a related device for the production of molded concrete bodies provided with clamping tongs distributed on the circumference of the pressure head as a coupling device is known from European patent 0 351 325. To assure an engagement and release of the upper mold faucet without disturbances a ring collar directed upward is formed on the mold faucet, the two clamping jaws of the tongs establishing an engagement with the ring collar during a closing operation. The clamping tongs are provided with tong arms pivotable about central tappet bearings, the clamping jaws as well as a spreading spring being disposed on the lower arm portions and a hydraulic cylinder being disposed between the upper arm portions. Further, centering struts vertically fixed to the pressure head turnable back and forward by means of a motor are allocated to the coupling device, the struts enabling a previous centering of the coupling faucet in its engagement position. Such devices have been well tried in practice in connection with rigid mold faucets integrally formed of corrosion resistant steel since they are robustly built and can be operated with technically simple means. However, the outer diameter of the coupling device is larger than the inner diameter of the exterior mold in this case so that the exterior mold can not be drawn over the coupling device. Instead, it is necessary to release the clamping tongs and to remove the coupling device before the exterior mold is pulled off. To prevent an accompanying detachment of the upper mold faucet due to clinging effects, special holding-down devices for the mold faucet are required.

SUMMARY OF THE INVENTION

It is a primary purpose of the invention to provide a device for the production of ring-shaped bodies of concrete enabling a minimization of operational disturbances and production-technically optimized operational processes, for example, the removal of the exterior mold with the coupling device activated.

According to the invention, the purpose is satisfied by providing each of the clamping units referred to as clamping tongs with a pressure cylinder, the cylinder housing of which, being disposed on the radially inner side, is fixedly connected by means of at least one tension strut with the radially outer clamping jaw or its clamping jaw sustainer and the piston of which, being effective radially outward, engages the radially inner clamping jaw.

The arrangement and formation of the different components according to the invention results in a safely operating and compact coupling device the operation of which cannot be affected by the entry of concrete parts. The arrangement of the cylinder housing at the radially inner side of the inner clamping jaw sustainer and the mechanical coupling of the cylinder housing movable in the effective direction with the radially outer clamping jaw sustainer has the effect that only a relatively narrow part of the whole coupling device is disposed on the outer side of the ring-shaped collar and that the outer diameter of the whole coupling device is smaller than the inner diameter of the exterior mold. Thus the exterior mold can be drawn off upwardly over the coupling device with the coupling device activated and therefore the mold faucet being held down. During a clamping operation, the piston of the cylinder unit acts on the inner clamping jaw sustainer in the radial direction while simultaneously the cylinder housing is moved radially inwardly by the hydraulic inner pressure. Due to the mechanical coupling to the radially outer clamping jaw sustainer it is taken along by the cylinder housing, that is, moved radially inwardly by the same amounts. The equally set opposed movements of the two clamping jaw sustainers will finally result in a tight attachment of their clamping jaws to the two sides of the ring-shaped collar. Since a plurality of clamping units is provided so as to be angularly displaced, a fixed engagement of the pairs of clamping jaws is effected after an initial fine centering of the previously positioned mold faucet, and thereby a positive fixation of the mold faucet on the pressure head in an exactly centered position is obtained.

For the maintenance of the shiftability of at least one clamping jaw and the cylinder housing, each clamping unit or clamping tong is preferably provided with a bridge fixed to a base plate of the pressure head, a radially oriented guiding rod on which the cylinder housing including the mechanically coupled outer clamping jaw sustainer as well as the inner clamping jaw sustainer are each slidably borne being fixed between the radially inner and outer limb of the bridge.

For an optimized operational safety an intercepting device for preventing an unintended detachment of the mold faucet from the clamping units is allocated to the coupling device formed according to the invention. To this end interception hooks protruding downwardly are provided on the clamping units, the interception hooks engaging correspondingly formed catch elements thus safely preventing a drop of the mold faucet.

A further object of the invention is a newly designed mold faucet for shaping the upper centering end of a molded concrete body to be used in one of the production devices described above. The mold faucet consisting of a shaping faucet part and an upper ring-shaped collar is provided with at least one engagement surface for at least one clamping element or clamping jaw of the coupling device on the upper end portion of the ring-shaped collar as well as a catch element for an interception hook below the engagement surface. The ring-shaped collar is disposed in the central portion of the faucet part and is either integrally formed with or fixedly welded to the latter.

As compared to known mold faucets the ring-shaped collar has a much larger height which approximately equals the height of the shaping faucet part.

The centering of a single upper faucet in the central axis of the device is efficaciously effected previous to or during the engagement of the clamping tongs with the aid of centering rods provided on the pressure head and protruding downward, the inclined surfaces of which slidably engage the upper and correspondingly formed end of the ring-shaped collar of the upper faucet during the lowering movement of the pressure head and will push the upper faucet into the central position.

BRIEF DESCRIPTION OF THE DRAWING

Further advantages, particularities, objects and features of the apparatus according to the invention will become more clear from the following detailed description, when read in conjunction with the accompanying drawing, in which.

DETAILED DESCRIPTION OF THE PREFERRED EMBODIMENTS

Figure 1:
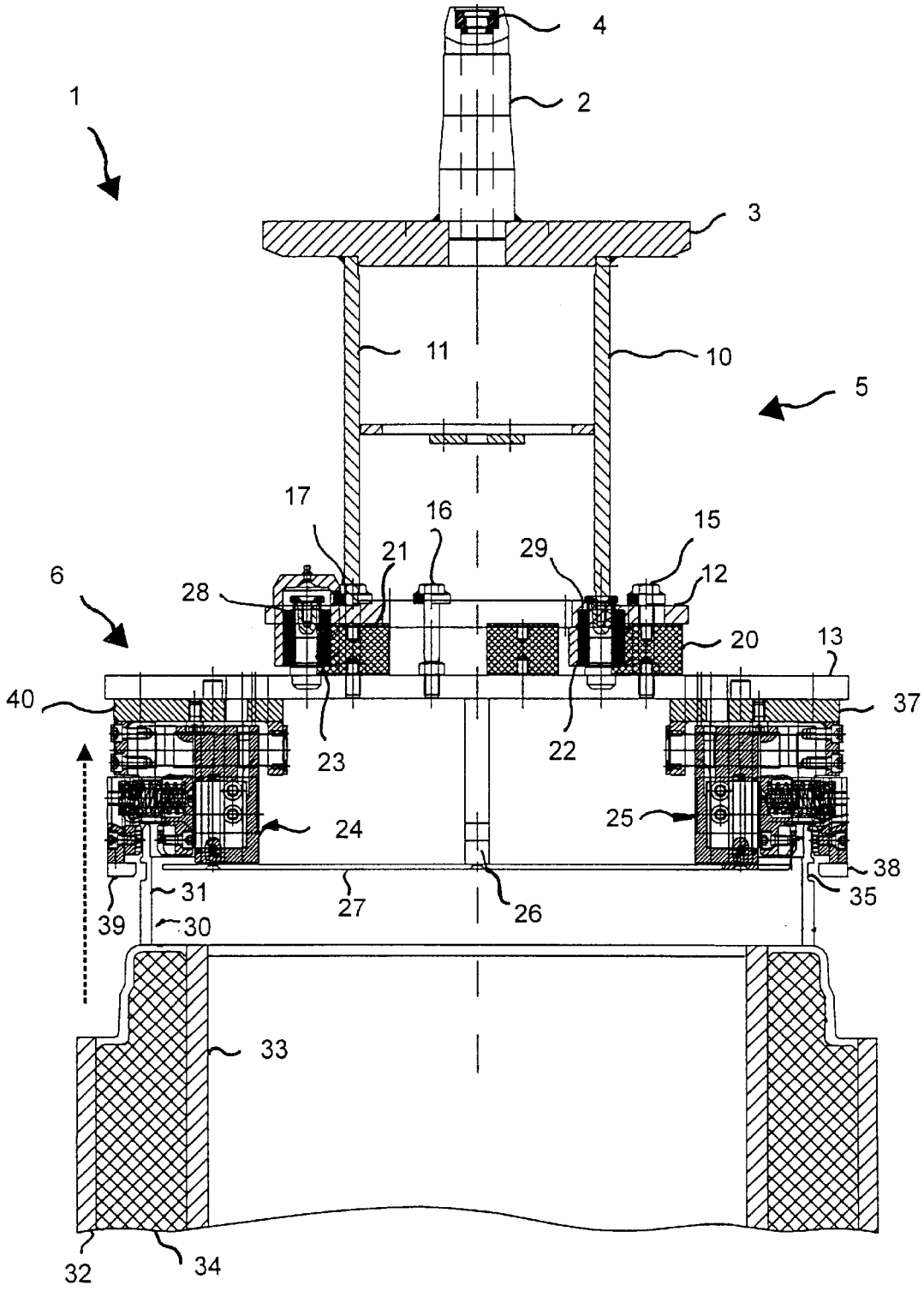
FIG. 1 is an axial cross sectional view of the upper part of an apparatus for the production of concrete pipes in accordance with the invention.

The production device partly shown in FIG. 1 comprises liftable and lowerable exterior mold 32 and hollow inner mold core 33 forming mold space 34, shown filled with the concrete mass. The mold space is closed by a bottom faucet (not shown), the bottom faucet shaping the lower centering end of the pipe to be produced with its specific form. For handling an upper mold faucet 30 closing mold space 34 on the upper side pressure head 1 is provided which is, with its central support tappet 2 and its upper support plate 3, centered and releasably connected, for example, by hydraulic clamping means, to a rotatably driven support construction liftable and lowerable by means of a motor.

Stable upper support plate 3 is fixedly connected to lower support plate 12 via a pipe portion or longitudinal struts 10, 11, for example, by means of screws 17, or welding or other suitable means. Below this circular disk-shaped support plate 12 base plate 13 is provided which is mounted to the support plate via screws 15 (or equivalent) and a plurality of angularly displaced elastic rubber buffers 20, 21 for damping vertical vibrations of support plate 12. Elastic rubber buffer sleeves 28, 29 disposed around bolts 22, 23 are intended to additionally suppress oscillations and vibrations effective in the circumferential direction.

In the embodiment shown in FIG. 1 coupling device 6 is formed by two clamping units or clamping tongs 24, 25 mounted on the bottom side of base plate 13 diametrically opposed to each other. Two centering struts 26 are directly fixed to the base plate and protrude downwardly, being disposed in symmetric angular displacement between the clamping units or clamping tongs. Each clamping unit 24, 25 is provided with interception hook 38, 39 engaging an element formed as snap ring groove 35 of ring-shaped collar 31 of mold faucet 30, in this case upon activation of the clamping unit. On the bottom side of the two clamping units 24, 25 and centering struts 26 is fixed protective bottom disk 27.

Clamping unit 24 of the coupling device according to FIG. 1 is described in detail with reference to FIGS. 2, 3 and together with the mold faucet schematically shown in FIG. 2*a*. Upper mold faucet 30 is a per se stiff ring-shaped body preferably consisting of corrosion resistant steel. A profiled ring shaped mold faucet bottom portion 30*a* is intended to shape the upper centering end of concrete pipe 34, as shown in FIG. 1. On the upper side of a radially extending inner portion immediately before its interface to a first vertical portion of faucet part 30*a*, a parallel, axially oriented ring-shaped collar 31 is integrally formed or rigidly attached, for example, by welding. The collar has a uniform wall thickness in lower part 123 and is provided with snap ring groove 35 facing radially outwardly and forming an engagement element for the interception hooks on the clamping unit. It is followed by a relatively thin-walled upper end portion 120, two circumferential surfaces 121, 122 of which form the engagement surface for the clamping jaws of the clamping unit. The upper edge of ring-shaped collar 31 is limited by inclined surfaces coming into a sliding engagement with the inclined surfaces of centering rod 26 (see FIG. 4) during the positioning of the mold faucet in its operation position.

Figure 2A:
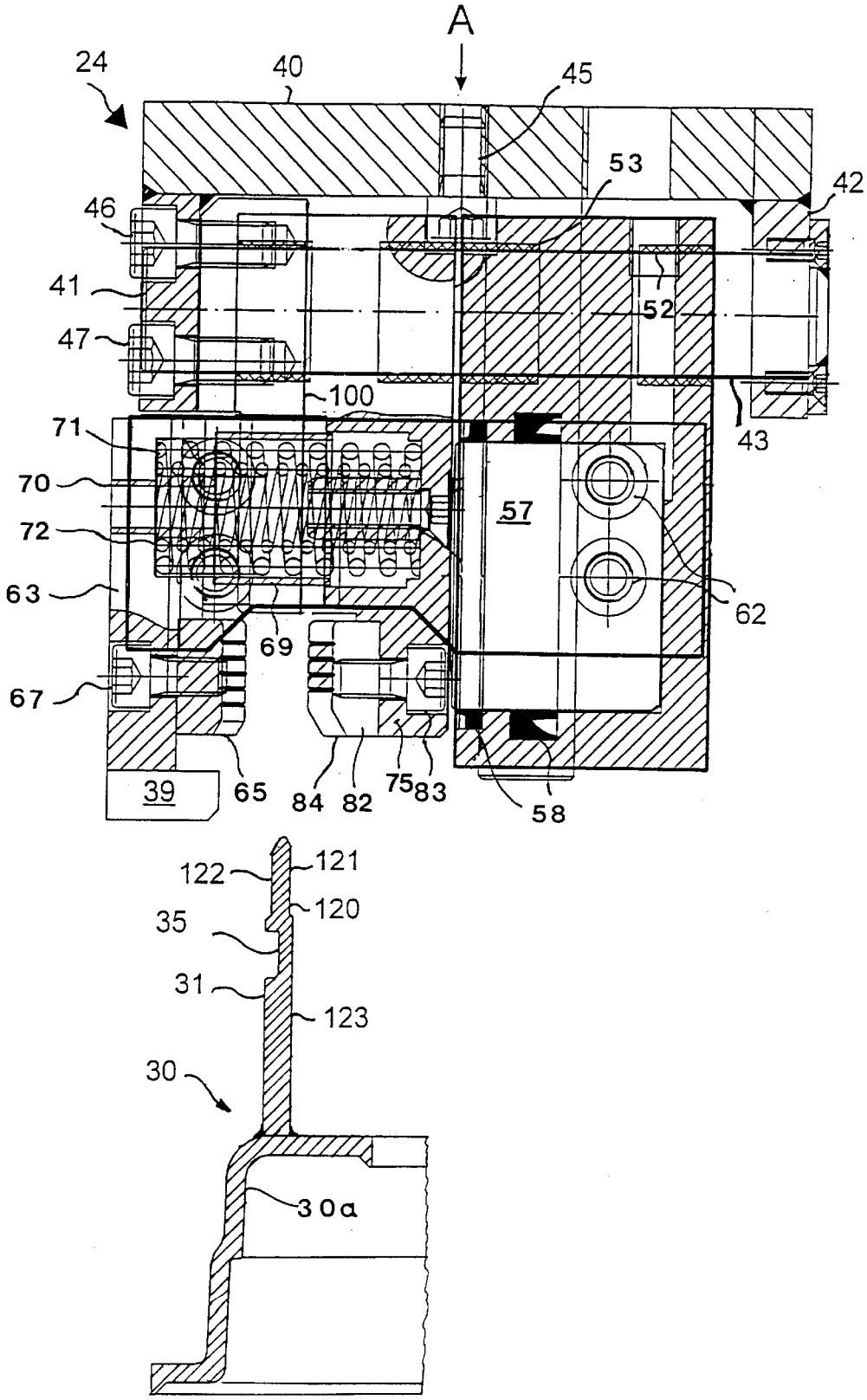
FIG. 2*a* is a longitudinal cross sectional view of a clamping tong of the coupling device according to FIG. 1.
Figure 2B:
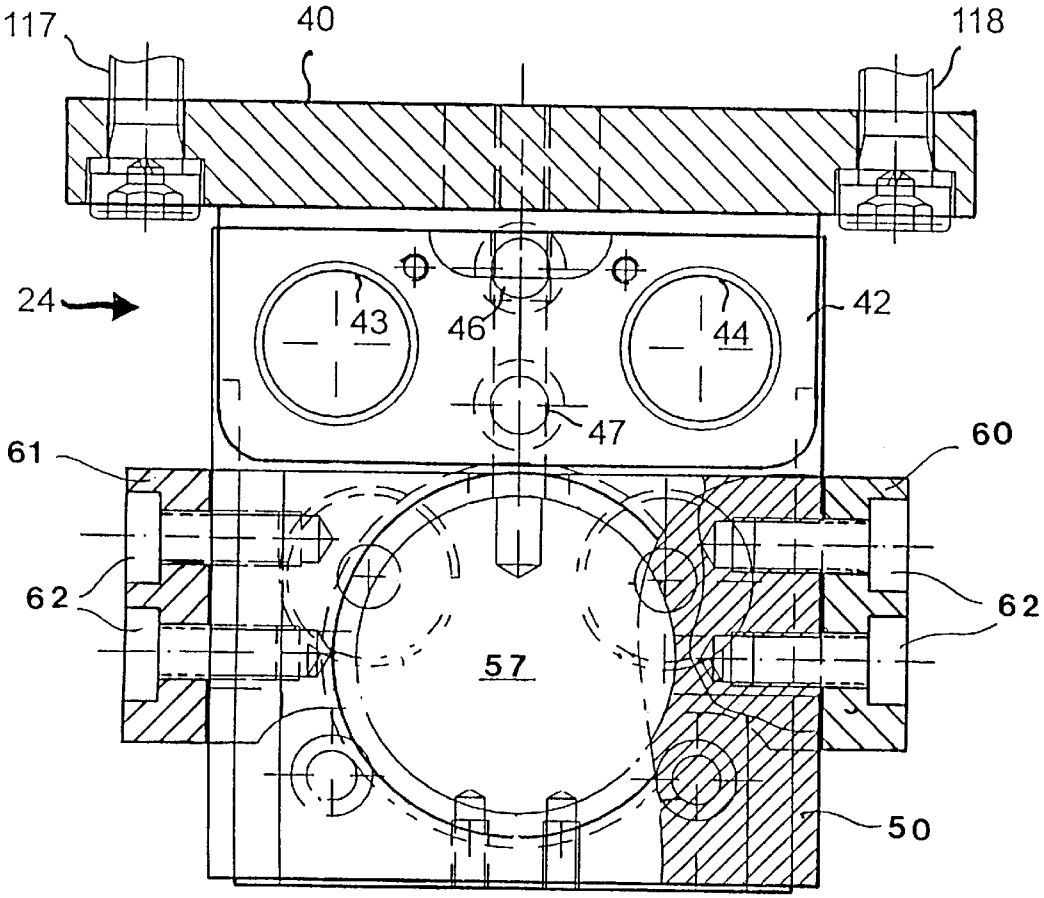
FIG. 2*b* is a partial cross sectional side view of the clamping tong of FIG. 1.
Figure 3:
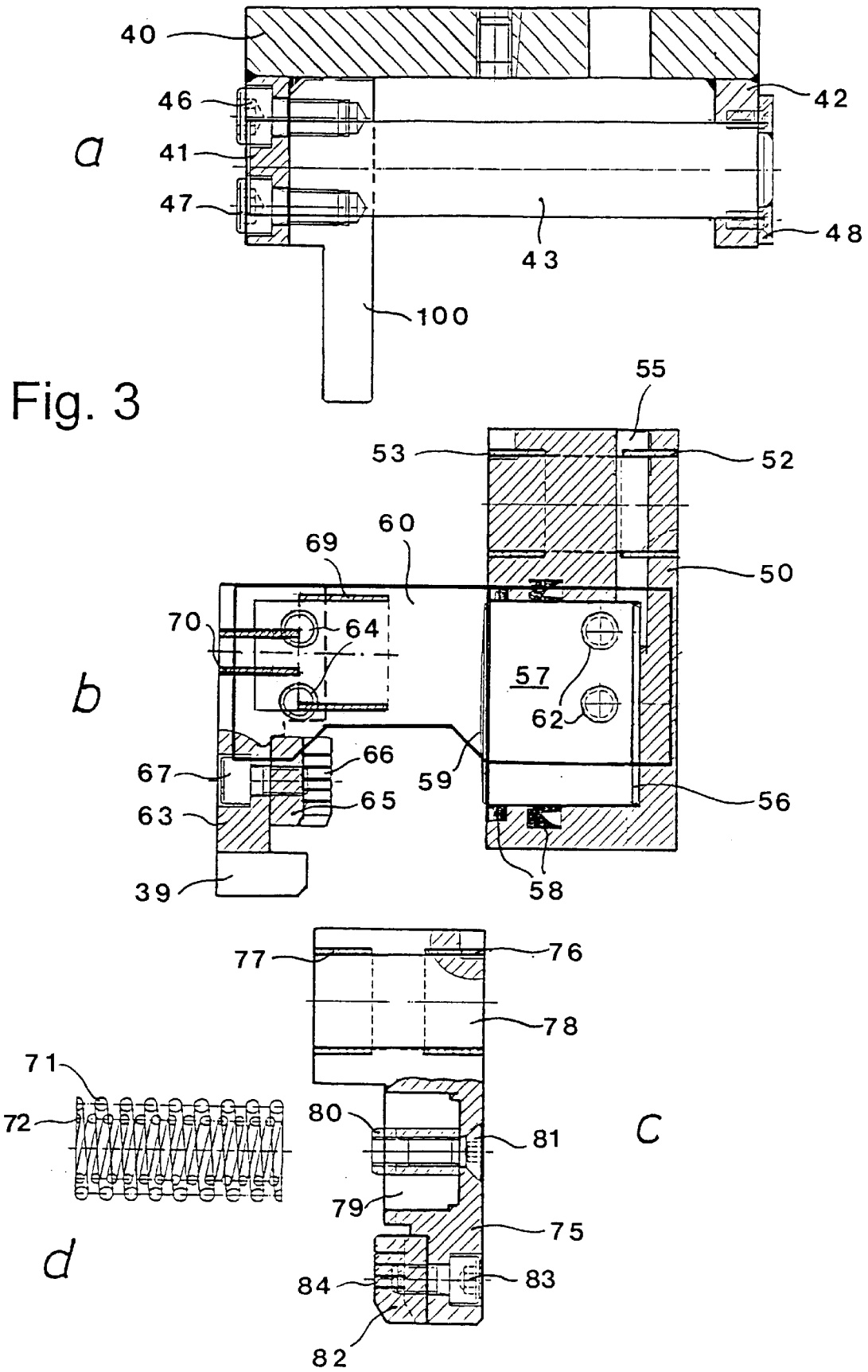
FIGS. 3*a* to 3*d* comprise composite exploded cross sectional views of individual components of a clamping unit according to FIG. 1.

Clamping unit 24, shown in FIGS. 2*a* and 2*b* in different cross sectional views, is fixed to the bottom side of base plate 13 with the aid of the upper end plate of its bracket 40, for example, by studs. Bracket 40 is provided with a radially inner and a radially outer limb 41, 42 to which two axially parallel and radially oriented guide rods 43, 44 are fixed. In the upper transverse plate of bracket 40 centering screw 45 is provided in a bore. As particularly shown in FIG. 3*a*, pressure strut 100 is fixed to the inner side of radially outer limb 41 by screws (for example) 46, 47. The lower end of the pressure strut applies pressure to the upper edge of ring-shaped collar 31 of mold faucet 30 during a molding operation. Plate 48 for fixing guide rods 43, 44 is screwed to the other bracket limb 42.

Cylinder housing 50, separately shown in FIG. 3*b*, is provided with two axially parallel bores 51, of which only one is shown in dotted lines, in its upper portion. Two end side guide bushings 52, 53 are disposed in the bores. With these bores 51 and guide bushings 52, 53, cylinder housing 50 is slidably guided on guide rods 43, 44. In the lower part of the cylinder housing, work chamber 56, supplied with pressure means through fluid conduit 55, is provided. Work chamber 56 is terminated by piston 57 on the face side. The piston is slidably guided by ring-shaped seals 58 in the work chamber and protruding over the (FIG. 3*b*) left face wall of the cylinder housing with its arched pressure surface 59 by a small amount in its fully retracted position. To each side wall of cylinder housing 50 is fixed, by appropriate means such as studs 62, dimensionally stable plate 60, 61 (see FIG. 2*b*) having the shape shown in FIG. 3*b* in a plan view. Between the left end portions of plates 60, 61 is fixed clamping jaw sustainer 63 by suitable means such as screws 64. A radially outer clamping jaw 65, having an active surface 66 in the shape of a segment of a circle, is fixed to the clamping jaw sustainer 63 by means of screws 67, for example. On the lower end of radially outer clamping jaw sustainer 63 is interception hook 39. In the upper part of the clamping jaw sustainer are provided guide bushing 69 and guide tube 70 for holding two coaxial spreading springs 71, 72, shown in detail in FIG. 3*d*, are provided in recess 68.

Between radially outer clamping jaw sustainer 63 and cylinder housing 50 is radially inner clamping jaw sustainer 75 (FIG. 3*c*) comprising two axially parallel bores 78 respectively lined with two sliding bushings 76, 77 in its upper portion. Guide rods 43, 44 protrude through bores 78 in a slidable attachment. Below the widened upper portions, recess 79 for accommodating and supporting spreading springs 71, 72 is formed in clamping jaw sustainer 75. Hollow tappet 80 is fixed by means of screw 81, for example, in the center of recess 79 as an inner spring guide. In a hollow at the lower end of clamping jaw sustainer 75, radially inner clamping jaw 82 is situated which can be replaced by releasing connection screws 83. Active surface 84 of the clamping jaw has the shape of a segment of a circle corresponding to the shape of the ring-shaped collar of the mold faucet. As can be seen particularly from FIG. 3*c*, the right face wall of clamping jaw sustainer 75 is planar so that in the assembled condition shown in FIG. 2*a* piston 57 is pressed against the face wall approximately in the area of the spring recess 79 to thereby effect a displacement of the clamping jaw sustainer on guide rods 43, 44.

Figure 4:
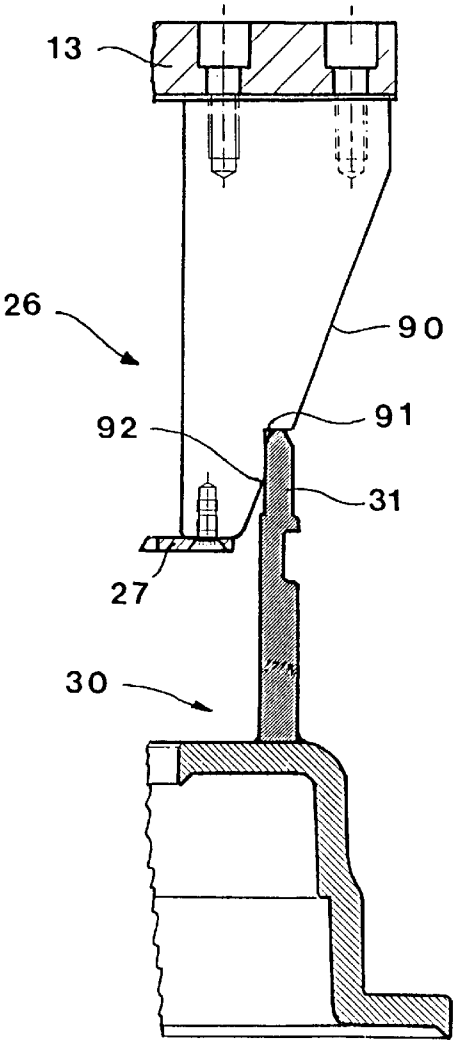
FIG. 4 is a schematic partial sectional view of a centering strut together with a centered mold faucet.

In FIG. 4 one of centering struts 26 is shown in a side view together with upper faucet 30 shown in an axial cross sectional view. Centering strut 26 has the shape of a narrow triangle and is fixed to base plate 13 in the way illustrated, for example, by means of studs. The narrow lower end is fixed to protection disk 27 by means of countersunk screws, for example. The radially inner side of the preferably plate-shaped centering strut 26 extends substantially vertically, and its outer side 90 extends in an acute angle with respect to the vertical plane. In the lower portion of inclined outer side 90 angular recess 91 is formed, the upper surface of which is formed with a support surface for the upper edge of ring-shaped collar 31 in the manner shown. Vertically extending lateral surface 92 of recess 91 forms a lateral contact surface for the ring-shaped collar and therewith for mold faucet 30 in its centered position.

The apparatus described above operates in the following manner. After mold space 34 has been filled with the concrete mass, mold faucet 30, loosely supplied into the access range of the coupling device, for example, on a table surface, is grasped by a lowering movement of pressure head 5. At the same time, an exact centering of mold faucet 30 in the central axis is effected by a sliding contact of the lower inclined surface of centering struts 26 and simultaneously the relative height position of the mold faucet or its ring shaped collar 31 is also set by the contact of the upper edge of the ring-shaped collar with the upper surfaces of recesses 91 of the centering struts. In this way it is assured that the two clamping jaws 65, 84, which are still open, are positioned exactly opposing contact surfaces 121, 122 on the upper portion of ring shaped collar 31 and that interception hooks 39 are also positioned exactly opposing snap ring grooves 35. By introducing hydraulic pressure liquid through conduit 55 a pressure acting on the end surface of piston 57 on the one hand and simultaneously on the opposed wall of cylinder housing 50 is generated in work chamber 56 of the cylinder housing. In this way the radially inner clamping jaw sustainer 75 is pushed to the left by piston 57, and the radially outer clamping jaw sustainer 63 is drawn to the left by the corresponding reaction movement of the slidably supported cylinder housing 50 due to the mechanical coupling effected by the two connection plates 60, 61. Due to the floating bearing and movability of clamping jaw sustainers 63, 75 a simultaneous engagement of its clamping jaws 65, 82 on the contact surfaces 121, 122 of the ring-shaped collar is therefore effected. Simultaneously, interception hooks 39 engage snap ring groove 35 so that the mold faucet is secured against a drop even in the case of an insufficient clamping effect.

Since the pressure means is simultaneously supplied to clamping units 24, 25, the clamping effect of clamping jaws 65, 84 of the different clamping units is also effected simultaneously and distributed about the circumference of the ring-shaped collar. The clamping forces applied to the upper section of ring-shaped collar 31 by clamping jaws 65, 84 are sufficiently large to press the mold faucet into the concrete mass and to simultaneously turn it back and forth due to a corresponding dimensioning of the cylinder unit and the cylinder pressure. Since ring-shaped collar 31 containing all the engagement elements is fixed approximately in the central region of faucet portion 30*a*, that is, immediately in front of the interface from the horizontal upper bridge into the vertical section of faucet portion 30*a*, the pressure forces and torques applied by the pressure head are optimally transmitted to upper mold faucet 30. Thereby a sufficient distance between the shaping lower faucet portion 30*a* and the coupling device is obtained due to the larger height of ring-shaped collar 31 so that escaping concrete mass cannot enter the area of the mechanically moved parts of the coupling device. Protection against entering concrete mass is enhanced by lower disk 27, the edge of which approximately opposes the interception hook. With the mechanical coupling of the radially outer clamping jaw sustainer 63 with cylinder housing 50 by means of lateral plates 60, 61, a narrow formation of all components positioned radially outside of the ring-shaped collar, that is, of the radially outer clamping jaw sustainers including their clamping jaws and their interception hooks, is enabled so that exterior mold 32 can move vertically upward as indicated by the arrow in FIG. 1, without colliding with protruding components of the coupling device.

The invention is not limited to the details and features of the embodiment described above. For example, clamping units 24, 25 may be mounted on the upper portion of the pressure head so as to be adjustable in the radial direction stepwise or continuously, whereby an adjustment of the coupling device to different sizes or diameters of the concrete pipes to be produced, including their upper mold faucets, can be realized.

Further, the coupling device described above is not limited to the utilization of the mold faucets described and illustrated, that is, mold faucets formed differently may also be used. The same applies to the centering struts described above which may also be formed as per se known centering fingers.

What is claimed is:

1. Apparatus for the production of ring-shaped bodies of concrete, the apparatus having a frame and comprising:

a liftable and lowerable exterior mold having an interior mold space;

a mold core limiting the mold space on the radially inner side of the exterior mold;

at least one shaking device for introducing vibrations into the filled-in concrete;

a bottom faucet closing the mold space at the bottom for shaping a lower centering end of a body to be produced;

an upper mold faucet for shaping an upper centering end of the body to be produced and provided with a ring-shaped collar on an upper side; and a liftable and lowerable, rotatable pressure head comprising a coupling device provided with at least two clamping units having driven clamping jaws, the clamping units being distributed around the circumference of the pressure head, the driven clamping jaws of said clamping units engaging the ring-shaped collar of the upper mold faucet, the outer diameter of the coupling device being smaller than the inner diameter of the exterior mold, each clamping unit being provided with inner and outer clamping jaw sustainers which are shiftable relatively against each other on a first straight line, and a pressure cylinder having a cylinder housing and a piston, the cylinder housing being radially shiftable on a second straight line, the cylinder housing being fixedly connected to the outer clamping jaw sustainer by means of at least one connection strut the piston acting radially outwardly and engaging the inner clamping jaw sustainer.

2. The apparatus according to claim 1, wherein the clamping units are mounted on the frame, the frame being provided with a hydraulically clampable centered support tappet by means of a dimensionally stable base plate and vibration dampers.

3. The apparatus according to claim 1 or 2, wherein at least one clamping jaw sustainer as well as the cylinder housing are shiftable along fixed guides in the effective direction of the clamping jaws.

4. The apparatus according to claim 3, and further comprising a base plate on the pressure head, wherein each clamping unit is provided with a bridge fixed to the base plate, at least one guide rod being attached between radially inner and radially outer limbs of said bridge, the cylinder housing and the inner clamping jaw sustainer being shiftably borne on said guide rod without being turnable.

5. The apparatus according to one of the claims 1 or 2, and further comprising an interception hook on at least one of the clamping units which engages, upon operation of the clamping jaws, a support element provided on the ring-shaped collar of the upper mold faucet.

6. The apparatus according to claim 1 or 2, wherein the clamping units are fixed to the pressure head so as to be radially adjustable.

7. The apparatus according to claim 1 or 2, wherein the ring-shaped collar of the upper mold faucet is provided with an upper section comprising two contact surfaces for a frictional engagement with the clamping jaws and a lower section which starts immediately below the contact surfaces and in which a snap ring groove is formed for receiving interception hooks.

8. The apparatus according to claim 1 or 2, wherein the inner clamping jaw sustainer is borne on two axially parallel guide rods so as to be shiftable relative to the cylinder housing also borne on the two guide rods.

9. The apparatus according to claim 1 or 2, wherein between the two clamping jaw sustainers of each clamping unit at least one spreading spring is disposed in the effective area of the respective pressure cylinder.

10. A mold faucet for shaping the upper centering end of a ring-shaped concrete body comprising of:

a shaping faucet part;

an upper ring-shaped collar;

at least one contact surface for a clamping means of a pressure head on an upper end portion of the ring-shaped collar; and an engagement element for interception hooks provided on the pressure head, the engagement element being provided on the ring-shaped collar below said contact surface;

wherein the ring-shaped collar is fixed in a central section of the faucet part.

11. The mold faucet according to claim 10, wherein the height of the ring-shaped collar is approximately equal to the height of the faucet part.

12. The mold faucet according to claim 10 or 11, wherein the ring-shaped collar is provided with an upper formed edge for the interaction with centering elements and with at least one pressure member.

13. The mold faucet according to claim 10 or 11, wherein the ring-shaped collar comprises a straight section of predetermined height having concentric walls below the engagement element for interception hooks.

* * * * *